US007096679B2

(12) United States Patent
Manole

(10) Patent No.: US 7,096,679 B2
(45) **Date of Patent: *Aug. 29, 2006**

(54) TRANSCRITICAL VAPOR COMPRESSION SYSTEM AND METHOD OF OPERATING INCLUDING REFRIGERANT STORAGE TANK AND NON-VARIABLE EXPANSION DEVICE

(75) Inventor: Dan M. Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 2 days.

This patent is subject to a terminal disclaimer.

(21) Appl. No.: 10/744,609

(22) Filed: Dec. 23, 2003

(65) Prior Publication Data

US 2005/0132729 A1 Jun. 23, 2005

(51) Int. Cl.
*F25B 1/00* (2006.01)

(52) U.S. Cl. ..... 62/115; 62/149

(58) Field of Classification Search ..... 62/115, 62/174, 498, 504, 509, 511, 513
See application file for complete search history.

(56) References Cited

U.S. PATENT DOCUMENTS

| | | | | |
|---|---|---|---|---|
| 933,682 | A | 9/1909 | Voorhees | |
| 1,408,453 | A | 3/1922 | Goosmann | |
| 1,591,302 | A | 7/1926 | Franklin | |
| 1,867,748 | A | 7/1932 | MacCabee | |
| 1,976,079 | A | 10/1934 | Mallinckrodt | 62/126 |
| 2,133,960 | A | 10/1938 | McCloy | 62/115 |
| 2,219,815 | A | 10/1940 | Jones | 257/9 |
| 2,482,171 | A | 9/1949 | Gygax | 62/127 |
| 2,617,265 | A | 11/1952 | Ruff | 62/3 |
| 2,778,607 | A | 1/1957 | Leoni | 257/24 |
| 2,901,894 | A | 9/1959 | Zearfoss, Jr. | 62/509 |
| 3,022,642 | A | 2/1962 | Long | 62/196 |
| 3,234,738 | A | 2/1966 | Cook | 60/59 |
| 3,365,905 | A | 1/1968 | Barbier | 62/196 |
| 3,400,555 | A | 9/1968 | Granryd | 62/498 |
| 3,413,815 | A | 12/1968 | Granryd | 62/6 |
| 3,423,954 | A | 1/1969 | Harnish et al. | 62/222 |
| 3,513,663 | A | 5/1970 | Martin, Jr. et al. | 62/159 |

(Continued)

FOREIGN PATENT DOCUMENTS

DE 278095 6/1912

(Continued)

OTHER PUBLICATIONS

Cooling Machinery and Apparatuses, GNTIMASH, Moscow, 1946, p. 56.

(Continued)

*Primary Examiner*—Mohammad M. Ali
(74) *Attorney, Agent, or Firm*—Baker & Daniels

(57) ABSTRACT

A transcritical vapor compression system includes a fluid circuit circulating a refrigerant in a closed loop. The fluid circuit has operably disposed therein, in serial order, a compressor, a first heat exchanger, at least one non-variable expansion device and a second heat exchanger. The compressor compresses the refrigerant from a low pressure to a supercritical pressure. The first heat exchanger is positioned in a high pressure side of the fluid circuit. The second heat exchanger is positioned in a low pressure side of the fluid circuit. The at least one non-variable expansion device reduces the pressure of the refrigerant from a supercritical pressure to a relatively lower pressure. A refrigerant storage vessel is in fluid communication with the fluid circuit and contains a variable mass of refrigerant whereby the capacity of the system may be controlled.

34 Claims, 4 Drawing Sheets

U.S. PATENT DOCUMENTS

| | | | | | |
|---|---|---|---|---|---|
| 3,597,183 | A | | 8/1971 | Murphy et al. | 62/114 |
| 3,638,446 | A | | 2/1972 | Palmer | 62/202 |
| 3,828,567 | A | | 8/1974 | Lesczynski | 62/160 |
| 3,858,407 | A | | 1/1975 | Schumacher | 62/217 |
| 3,872,682 | A | | 3/1975 | Shook | 62/114 |
| 3,919,859 | A | | 11/1975 | Ross | 62/503 |
| 4,009,596 | A | | 3/1977 | Morse | 62/503 |
| 4,019,679 | A | | 4/1977 | Vogt et al. | 237/2 |
| 4,048,814 | A | | 9/1977 | Quack | 62/335 |
| 4,136,528 | A | | 1/1979 | Vogel et al. | 62/174 |
| 4,182,136 | A | | 1/1980 | Morse | 62/503 |
| 4,205,532 | A | | 6/1980 | Brenan | 62/115 |
| 4,439,996 | A | | 4/1984 | Frohbieter | 62/174 |
| 4,631,926 | A | | 12/1986 | Goldshtein et al. | 62/115 |
| 4,679,403 | A | | 7/1987 | Yoshida et al. | 62/114 |
| 4,702,086 | A | | 10/1987 | Nunn, Sr. et al. | 62/113 |
| 4,765,143 | A | * | 8/1988 | Crawford et al. | 60/671 |
| 4,811,568 | A | | 3/1989 | Horan et al. | 62/200 |
| 5,042,262 | A | | 8/1991 | Gyger et al. | 62/64 |
| 5,062,274 | A | | 11/1991 | Shaw | 62/117 |
| 5,142,884 | A | | 9/1992 | Scaringe et al. | 62/324.4 |
| 5,167,128 | A | | 12/1992 | Bottum | 62/174 |
| 5,174,123 | A | | 12/1992 | Erickson | |
| 5,245,836 | A | | 9/1993 | Lorentzen et al. | |
| 5,375,426 | A | * | 12/1994 | Burgener | 62/85 |
| 5,394,709 | A | | 3/1995 | Lorentzen | 62/402 |
| 5,400,615 | A | * | 3/1995 | Pearson | 62/277 |
| 5,402,646 | A | * | 4/1995 | Rathbone | 62/646 |
| 5,431,026 | A | | 7/1995 | Jaster | |
| 5,497,631 | A | | 3/1996 | Lorentzen et al. | 62/115 |
| 5,611,547 | A | | 3/1997 | Baugh et al. | 277/121 |
| 5,655,378 | A | | 8/1997 | Pettersen | 62/174 |
| 5,685,160 | A | | 11/1997 | Abersfelder et al. | |
| 5,692,389 | A | | 12/1997 | Lord et al. | |
| 5,802,873 | A | * | 9/1998 | Howard | 62/646 |
| 5,806,324 | A | | 9/1998 | Shaw | 62/99 |
| 5,806,341 | A | * | 9/1998 | Rathbone | 62/646 |
| 5,829,262 | A | | 11/1998 | Urata et al. | |
| 6,042,342 | A | | 3/2000 | Orian | 417/207 |
| 6,044,655 | A | | 4/2000 | Ozaki et al. | |
| 6,073,454 | A | | 6/2000 | Spauschus et al. | |
| 6,085,544 | A | | 7/2000 | Sonnekalb et al. | |
| 6,105,386 | A | | 8/2000 | Kuroda et al. | |
| 6,112,532 | A | | 9/2000 | Bakken | |
| 6,112,547 | A | | 9/2000 | Spauschus et al. | |
| 6,182,456 | B1 | | 2/2001 | Yamaguchi et al. | 62/222 |
| 6,185,955 | B1 | | 2/2001 | Yamamoto | |
| 6,250,099 | B1 | | 6/2001 | Furuya et al. | |
| 6,298,674 | B1 | | 10/2001 | Finkenberger et al. | 62/115 |
| 6,343,486 | B1 | | 2/2002 | Mizukami | 62/509 |
| 6,349,564 | B1 | | 2/2002 | Lingelbach et al. | 62/510 |
| 6,385,980 | B1 | | 5/2002 | Sienel | |
| 6,385,981 | B1 | | 5/2002 | Vaisman | |
| 6,418,735 | B1 | | 7/2002 | Sienel | 62/115 |
| 6,457,325 | B1 | * | 10/2002 | Vetter | 62/473 |
| 6,460,358 | B1 | | 10/2002 | Hebert | 62/225 |
| 6,484,519 | B1 | * | 11/2002 | Hesse et al. | 62/116 |
| 6,494,051 | B1 | * | 12/2002 | Sakakibara et al. | 62/225 |
| 6,606,867 | B1 | * | 8/2003 | Sienel | 62/113 |
| 6,698,234 | B1 | * | 3/2004 | Gopalnarayanan et al. | 62/505 |
| 6,739,141 | B1 | * | 5/2004 | Sienel et al. | 62/87 |
| 2002/0050143 | A1 | | 5/2002 | Watanabe et al. | 62/204 |

FOREIGN PATENT DOCUMENTS

| | | | | |
|---|---|---|---|---|
| DE | 1 021 868 | | | 1/1958 |
| DE | 24 01 120 | | | 7/1975 |
| DE | 26 04 043 | | | 8/1976 |
| DE | 26 60 122 | | | 1/1983 |
| EP | 0 174 027 | | | 9/1985 |
| EP | 0 604 417 | | | 4/1996 |
| EP | 0 617 782 | | | 5/1997 |
| EP | 0 424 474 | | | 11/1997 |
| EP | 0 672 233 | | | 11/1997 |
| EP | 1 043 550 | A1 | | 10/2000 |
| GB | 1042975 | | | 7/1963 |
| JP | 11-63686 | A | * | 3/1999 |
| JP | 11-63694 | A | | 3/1999 |
| JP | 11-201560 | A | * | 7/1999 |
| JP | 2000-46420 | | | 2/2000 |
| JP | 2001-221517 | | | 8/2001 |
| JP | 2002-195673 | A | * | 7/2002 |
| SU | 1521998 | | | 11/1989 |
| WO | WO 90/07683 | | | 7/1990 |

OTHER PUBLICATIONS

Patent Abstracts of Japan, vol. 13, No. 489, M888, abstract of JP 01-193561, publ. Aug. 3, 1989.

Principles of Refrigeration, by W.B. Gosney; Cambridge University Press, 1982.

Refrigeration Engineering by H.J. MacIntire, Refrigerants and Properties of Vapors, pp. 60-61, 1937.

* cited by examiner

TRANSCRITICAL VAPOR COMPRESSION SYSTEM AND METHOD OF OPERATING INCLUDING REFRIGERANT STORAGE TANK AND NON-VARIABLE EXPANSION DEVICE

BACKGROUND OF THE INVENTION

1. Field of the Invention

The present invention relates to vapor compression systems and, more particularly, to a transcritical multi-stage vapor compression system.

2. Description of the Related Art

Vapor compression systems are used in a variety of applications including heat pump, air conditioning, and refrigeration systems. Such systems typically employ working fluids, or refrigerants, that remain below their critical pressure throughout the entire vapor compression cycle. Some vapor compression systems, however, such as those employing carbon dioxide as the refrigerant, typically operate as transcritical systems wherein the refrigerant is compressed to a pressure exceeding its critical pressure and wherein the suction pressure of the refrigerant is less than the critical pressure of the refrigerant. The basic structure of such a system includes a compressor for compressing the refrigerant to a pressure that exceeds its critical pressure. Heat is then removed from the refrigerant in a first heat exchanger, e.g., a gas cooler. The pressure of the refrigerant discharged from the gas cooler is reduced in an expansion device and the low pressure refrigerant then enters a second heat exchanger, e.g., an evaporator, where it absorbs thermal energy before being returned, as a vapor, to the compressor.

The expansion devices employed in such systems are often variable expansion valves that can be adjusted to control the operation of the system. It is also known to combine such variably adjustable expansion valves with a flash tank and a two stage compressor whereby the variably adjustable expansion valves are disposed on the inlet and outlet side of the flash tank. The flash gas tank also includes an economizer line conveying refrigerant vapor from the tank to a point between the two stages of the compressor assembly. The variable expansion valves upstream and downstream of the flash gas tank can be used to regulate the quantity of refrigerant contained within the flash tank and thereby also regulate the pressure within the gas cooler.

One problem associated with use of such variable expansion valves is that they are expensive. Another problem is that they have moving parts and therefore are subject to mechanical failure.

An inexpensive and reliable apparatus for adjusting the efficiency and capacity of a transcritical multi-stage vapor compression system is desirable.

SUMMARY OF THE INVENTION

The present invention provides a transcritical vapor compression system that includes a non-variable expansion device, such as a capillary tube, and a refrigerant storage vessel that contains a variable mass of refrigerant. By controlling the mass of refrigerant within the refrigerant storage tank, the remaining charge of refrigerant actively circulating within the vapor compression system is also controlled. Further, by controlling the charge of actively circulated refrigerant, the gas cooler pressure and, consequently, the capacity and efficiency of the vapor compression system can be regulated.

The invention comprises, in one form thereof, a transcritical vapor compression system including a fluid circuit circulating a refrigerant in a closed loop. The fluid circuit has operably disposed therein, in serial order, a compressor, a first heat exchanger, at least one non-variable expansion device and a second heat exchanger. The compressor compresses the refrigerant from a low pressure to a supercritical pressure. The first heat exchanger is positioned in a high pressure side of the fluid circuit and contains refrigerant at a first supercritical pressure. The second heat exchanger is positioned in a low pressure side of the fluid circuit and contains refrigerant at a second subcritical pressure. The at least one non-variable expansion device reduces the pressure of the refrigerant from a supercritical pressure to a relatively lower pressure wherein the at least one non-variable expansion device defines a pressure reduction substantially equivalent to the pressure difference between the first pressure and the second pressure. A refrigerant storage vessel is in fluid communication with the fluid circuit and has a variable mass of refrigerant stored therein.

The present invention comprises, in another form thereof, a transcritical vapor compression system including a fluid circuit circulating a refrigerant in a closed loop. The fluid circuit has operably disposed therein, in serial order, a compressor, a first heat exchanger, at least one non-variable expansion device and a second heat exchanger. The compressor compresses the refrigerant from a low pressure to a supercritical pressure. The first heat exchanger is positioned in a high pressure side of the fluid circuit and contains refrigerant at a first supercritical pressure. The second heat exchanger is positioned in a low pressure side of the fluid circuit and contains refrigerant at a second subcritical pressure. The at least one non-variable expansion device reduces the pressure of the refrigerant from a supercritical pressure to a relatively lower pressure wherein the at least one non-variable expansion device defines a pressure reduction substantially equivalent to the pressure difference between the first pressure and the second pressure. A refrigerant storage vessel is in fluid communication with the non-variable expansion device between the first and second heat exchangers. A temperature adjustment device is disposed in thermal exchange with the refrigerant storage vessel wherein a temperature of refrigerant in the refrigerant storage vessel is adjustable with the temperature adjustment device.

The present invention comprises, in yet another form thereof, a method of controlling a transcritical vapor compression system. A fluid circuit circulating a refrigerant in a closed loop is provided. The fluid circuit has operably disposed therein, in serial order, a compressor, a first heat exchanger, at least one non-variable expansion device and a second heat exchanger. The refrigerant is compressed from a low pressure to a supercritical pressure in the compressor. Thermal energy is removed from the refrigerant in the first heat exchanger. The pressure of the refrigerant is reduced in the at least one non-variable expansion device wherein the at least one non-variable expansion device defines a pressure reduction substantially equivalent to the pressure difference between a first supercritical pressure of the refrigerant in the first heat exchanger and a second subcritical pressure of the refrigerant in the second heat exchanger. Thermal energy is added to the refrigerant in the second heat exchanger. A refrigerant storage vessel in fluid communication with the fluid circuit is provided and the mass of the refrigerant within the refrigerant storage vessel is controlled to thereby regulate the capacity of the system.

An advantage of the present invention is that the capacity and efficiency of the system can be regulated with inexpensive non-moving parts. Thus, the system of the present invention is less costly and more reliable than prior art systems.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
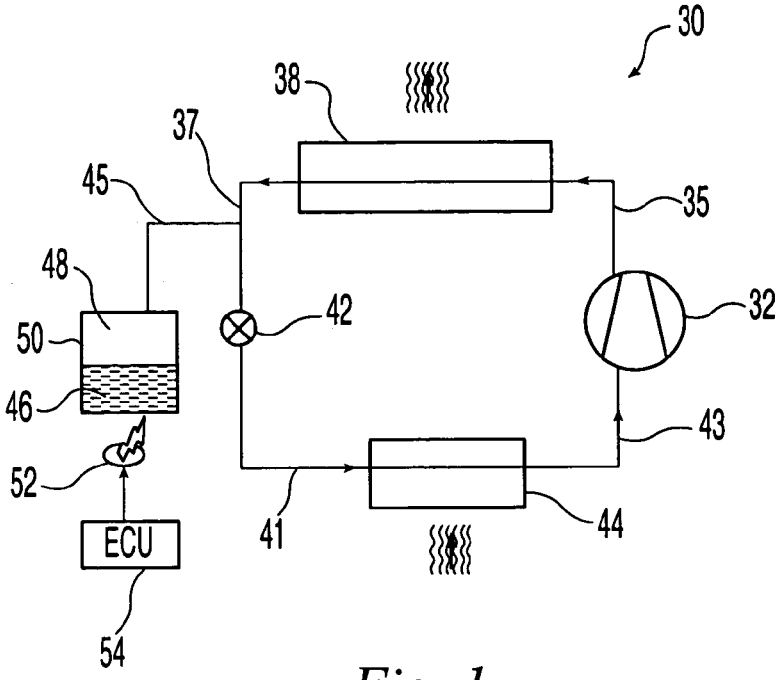
FIG. 1 is a schematic view of a vapor compression system in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

A vapor compression system 30 in accordance with the present invention is schematically illustrated in FIG. 1 as including a fluid circuit circulating refrigerant in a closed loop. System 30 has a single- or multi-stage compressor 32 which may employ any suitable type of compression mechanism such as a rotary, reciprocating or scroll-type compressor mechanism. The compressor 32 compresses the refrigerant from a low pressure to a supercritical pressure. A heat exchanger that can be in the form of a conventional gas cooler 38 cools the refrigerant discharged from compression mechanism 32. The pressure of the refrigerant is reduced from a supercritical pressure to a relatively lower pressure, e.g., a subcritical pressure, by a non-variable expansion device 42, which may be a capillary tube, a fixed orifice plate or other suitable fixed expansion device.

After the pressure of the refrigerant is reduced by expansion device 42, the refrigerant enters yet another heat exchanger in the form of an evaporator 44 positioned in a high pressure side of the fluid circuit. The refrigerant absorbs thermal energy in the evaporator 44 as the refrigerant is converted from a liquid phase to a vapor phase. The evaporator 44 may be of a conventional construction well known in the art. After exiting evaporator 44, the refrigerant is returned to compression mechanism 32 and the cycle is repeated.

Also included in system 30 is a refrigerant storage vessel in the form of a flash gas tank 50 having a variable mass of refrigerant stored therein. In illustrated system 30, flash gas tank 50 is in fluid communication with system 30 between gas cooler 38 and non-variable expansion device 42 and stores a variable mass of refrigerant as discussed in greater detail below.

As shown in FIG. 1, schematically represented fluid lines or conduits 35, 37, 41, and 43 provide fluid communication between compression mechanism 32, gas cooler 38, expansion device 42, evaporator 44 and compression mechanism 32 in serial order. The fluid circuit extending from the output of the compressor 32 to the input of the compressor 32 has a high pressure side and a low pressure side. The high pressure side extends from the output of compressor 32 to expansion device 42 and includes conduit 35, gas cooler 38 and conduit 37. The low pressure side extends from expansion device 42 to compressor 32 and includes conduit 41, evaporator 44 and conduit 43.

In operation, the illustrated embodiment of system 30 is a transcritical system utilizing carbon dioxide as the refrigerant wherein the refrigerant is compressed above its critical pressure and returns to a subcritical pressure with each cycle through the vapor compression system. Refrigerant enters the expansion device 42 at the supercritical pressure. The pressure of the refrigerant is lowered to a subcritical pressure as the refrigerant passes through expansion device 42.

Capacity control for such a transcritical system differs from a conventional vapor compression system wherein the refrigerant remains at subcritical pressures throughout the vapor compression cycle. In such subcritical systems, capacity control is often achieved using thermal expansion valves to vary the mass flow through the system and the pressure within the condenser is primarily determined by the ambient temperature. In a transcritical system, the capacity of the system is often regulated by controlling the pressure within the high pressure gas cooler while maintaining a substantially constant mass flow rate. The pressure within the gas cooler may be regulated by controlling the total charge of refrigerant circulating in the system wherein an increase in the total charge results in an increase in the mass and pressure of the refrigerant within the gas cooler, e.g., cooler 38, and an increase in the capacity of the system. On the other hand, a decrease in the circulating charge results in a decrease in the pressure within the gas cooler and a decrease in the capacity of the system. The efficiency of the system will also vary with changes in the pressure in gas cooler 38. However, gas cooler pressures that correspond to the optimal efficiency of system 30 and the maximum capacity of system 30 will generally differ.

By regulating the mass of the refrigerant contained within flash gas tank 50, the total charge of the refrigerant that is actively circulating within system 30 can be controlled and, thus, the pressure of gas cooler 38 and the capacity and efficiency of system 30 can also be controlled. The mass of refrigerant contained within tank 50 may be controlled by various means including the regulation of the temperature of tank 50 or the regulation of the available storage volume within tank 50 for containing refrigerant.

In the embodiment of FIG. 1, the mass of refrigerant contained within tank 50 is controlled by regulation of the temperature of tank 50. More particularly, a heater/cooler 52 is disposed proximate the flash gas tank 50 such that the heater cooler 52 can heat or cool the tank 50 and the refrigerant therein.

An electronic control unit (ECU) 54 may be used to control the operation of the heater/cooler 52 based upon temperature and/or pressure sensor readings obtained at appropriate locations in the system, e.g., temperature and pressure data obtained at the inlet and outlet of gas cooler 38 and evaporator 44 and in flash gas tank 50 and thereby determine the current capacity of the system and load being placed on the system. Manole describes another method of determining the pressure of a gas cooler in a transcritical system by taking external temperature measurements of the gas cooler in U.S. Provisional Patent Application Ser. No. 60/505,817 entitled METHOD AND APPARATUS FOR DETERMINING SUPERCRITICAL PRESSURE IN HEAT EXCHANGER filed on Sep. 25, 2003 which may also be used with the present invention and is hereby incorporated herein by reference. The pressure within gas cooler 38 may also be determined by taking temperature measurements of the ECU 54 may also control the operation of the heater/cooler 52 based upon work done by compressor 32 as measured with a multimeter or the pressure at the exit of compressor 32 as measured with a pressure gauge. As described above heater/cooler 52 is controllable such that refrigerant may be accumulated or released in or from the flash gas tank 50 to thereby increase or decrease the capacity of the system to correspond to the load placed on the system.

In the embodiment of FIG. 1, the illustrated flash gas tank 50 is shown having a single fluid line 45 providing a fluid communication port between the tank and the system at a location between gas cooler 38 and expansion device 42. In this embodiment, fluid line 45 provides for both the inflow and outflow of refrigerant to and from tank 50 and all refrigerant communicated to and from tank 50 is communicated by fluid line 45. Fluid line 45 provides an unregulated fluid passage between tank 50 and fluid line 37 leading to expansion device 42, i.e., there is no valve present in fluid line 37 that is used to regulate the flow of refrigerant therethrough during operation of the vapor compression system. Alternative embodiments, however, could employ a valve in fluid line 45 to regulate the flow of refrigerant to and from tank 50.

Figure 2:
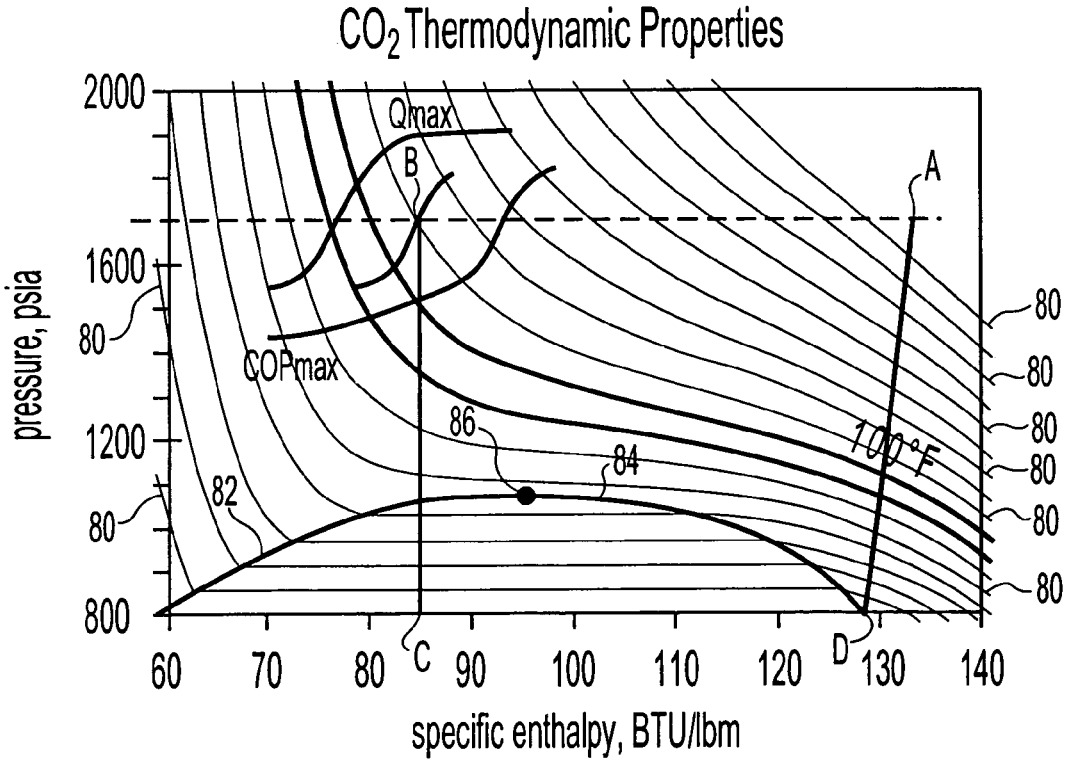
FIG. 2 is graph illustrating the thermodynamic properties of carbon dioxide.

The thermodynamic properties of carbon dioxide are shown in the graph of FIG. 2. Lines 80 are isotherms and represent the properties of carbon dioxide at a constant temperature. Lines 82 and 84 represent the boundary between two phase conditions and single phase conditions and meet at point 86, a maximum pressure point of the common line defined by lines 82, 84. Line 82 represents the liquid saturation curve while line 84 represents the vapor saturation curve.

The area below lines 82, 84 represents the two phase subcritical region where boiling of carbon dioxide takes place at a constant pressure and temperature. The area above point 86 represents the supercritical region where cooling or heating of the carbon dioxide does not change the phase (liquid/vapor) of the carbon dioxide. The phase of carbon dioxide in the supercritical region is commonly referred to as "gas" instead of liquid or vapor.

The lines $Q_{max}$ and $COP_{max}$ represent gas cooler discharge values for maximizing the capacity and efficiency respectively of the system. The central line positioned therebetween represents values that provide relatively high, although not maximum, capacity and efficiency. Moreover, if the system is operated to correspond to the central line, when the system fails to operate according to design parameters defined by this central line, the system will suffer a decrease in either the capacity or efficiency and an increase in the other value unless such variances are of such magnitude that they represent a point no longer located between the $Q_{max}$ and $COP_{max}$ lines.

Point A represents the refrigerant properties as discharged from compression mechanism 32 and at the inlet of gas cooler 38. Point B represents the refrigerant properties at the outlet of gas cooler 38 and the inlet to expansion device 42. Point C represents the refrigerant properties at the inlet of evaporator 44 and outlet of expansion device 42. Point D represents the refrigerant properties at the inlet to compression mechanism 32 and the outlet of evaporator 44. Movement from point D to point A represents the compression of the refrigerant. As can be seen, compressing the refrigerant both raises its pressure and its temperature. Moving from point A to point B represents the cooling of the high pressure refrigerant at a constant pressure in gas cooler 38. Movement from point B to point C represents the action of expansion device 42 which lowers the pressure of the refrigerant to a subcritical pressure.

Figure 3:
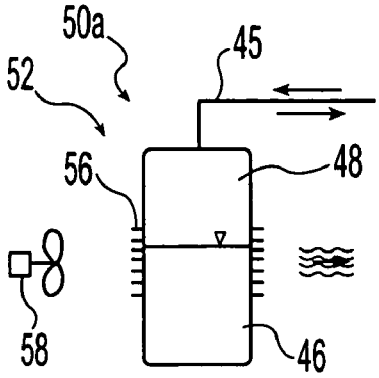
FIG. 3 is a schematic view of one embodiment of the flash gas tank of FIG. 1.
Figure 4:
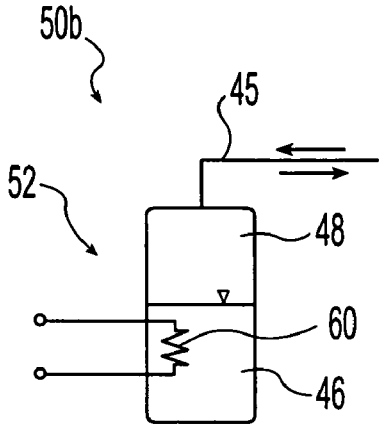
FIG. 4 is a schematic view of another embodiment of the flash gas tank of FIG. 1.

More specifically, in the embodiment illustrated in FIG. 1, points B and C are at the supercritical pressure within gas cooler 38 and points C and D are at the subcritical pressure in evaporator 44 and the movement from point B to point C represents the pressure reduction defined by non-variable expansion device 42. Similarly, in the embodiments illustrated in FIGS. 7–9, non-variable expansion devices 42*a* and 42*b* together define a pressure reduction that is equivalent to the difference in pressure between gas cooler 38 and evaporator 44. The illustrated systems, are relatively basic systems and additional components may be added to the system, such as accumulators and receivers, which may have a slight impact on the temperature and pressure of the refrigerant which diverges from that represented in FIG. 3. FIG. 3, however, does represent the basic functionality of a transcritical system. In the present invention, the pressure reduction between the gas cooler and the evaporator, which is schematically represented by the movement from point B to point C is substantially equivalent to the pressure reduction defined by the non-variable expansion devices positioned between the gas cooler and evaporator. In other words, there is no variable expansion device located between the gas cooler and the evaporator to adjustably control the pressure reduction of the refrigerant between these two components.

Movement from point C to point D represents the action of evaporator 44. Since the refrigerant is at a subcritical pressure in evaporator 44, thermal energy is transferred to the refrigerant to change it from a liquid phase to a gas phase at a constant temperature and pressure. The capacity of the system (when used as a cooling system) is determined by the mass flow rate through the system and the length of line C-D which in turn is determined by the specific enthalpy of the refrigerant at the evaporator inlet, i.e., the location of point C. Thus, reducing the specific enthalpy at the evaporator inlet without substantially changing the mass flow rate and without altering the other operating parameters of system 30, will result in a capacity increase in the system. This can be done by decreasing the mass of refrigerant contained in flash gas tank 50, thereby increasing both the mass and pressure of refrigerant contained in gas cooler 38. If the refrigerant in gas cooler 38 is still cooled to the same gas cooler discharge temperature, this increase in gas cooler pressure will shift line A–B upwards and move point B to the left (as depicted in FIG. 2) along the isotherm representing the outlet temperature of the gas cooler. This, in turn, will shift point C to the left and increase the capacity of the system. Similarly, by increasing the mass of refrigerant contained in tank 50, the mass and pressure of refrigerant contained within gas cooler 38 can be reduced to thereby reduce the capacity of the system. Consequently, controlling the mass of refrigerant within flash tank 50 provides a means for controlling the capacity and efficiency of the system.

During compression of the refrigerant, vapor at a relatively low pressure and temperature enters compression mechanism 32 and is discharged therefrom at a higher temperature and a supercritical discharge pressure. When tank 50 relies upon temperature regulation to control the mass of refrigerant contained therein, tank 50 is advantageously positioned to receive refrigerant at a point after the refrigerant has been cooled in gas cooler 38. The mass of refrigerant contained within tank 50 is dependent upon the density of the refrigerant and the available storage volume within tank 50. The density of the refrigerant is, in turn, dependent upon the relative amounts of the liquid phase fraction 46 and the vapor phase fraction 48 of the refrigerant that is contained within tank 50. By increasing the quantity of the liquid phase refrigerant 46 in tank 50, the mass of the refrigerant contained therein is also increased. Similarly, the mass of the refrigerant contained in tank 50 may be decreased by decreasing the quantity of liquid phase refrigerant 46 contained therein. By reducing the temperature of the refrigerant within tank 50 below the saturation temperature of the refrigerant, the quantity of liquid phase refrigerant 46 contained within tank 50 may be increased. Similarly, by raising the temperature of tank 50, and the refrigerant contained therein, some of the liquid phase refrigerant 46 can be evaporated and the quantity of the liquid phase refrigerant 46 contained therein may be reduced. A system in which a vessel containing a variable mass of refrigerant is provided between two stages of a multi-stage compressor mechanism is described by Manole in a U.S. patent application entitled MULTI-STAGE VAPOR COMPRESSION SYSTEM WITH INTERMEDIATE PRESSURE VESSEL, Ser. No. 10/653,581, filed on Sep. 2, 2003, and is hereby incorporated herein by reference.

In the embodiment of FIG. 1, the pressure of the refrigerant within tank 50 may exceed the supercritical pressure of the refrigerant, in which case, the refrigerant may not discretely separate into liquid and vapor phases. However, controlling the temperature of tank 50 will still alter the density of the refrigerant within tank 50 and, thus, alter the mass of refrigerant within tank 50. For those embodiments illustrated in FIGS. 7–9, the pressure of the refrigerant is advantageously reduced to a subcritical pressure by pressure reduction device 42*a* and the refrigerant contained within tank 50 can be more readily converted between its liquid and vapor phases.

Several exemplary embodiments of the flash gas tank 50 and the heater/cooler 52 are represented in FIGS. 3–6. Embodiment 50*a* is schematically represented in FIG. 3 and utilizes an air blower to cool tank 50*a*. Illustrated tank 50*a* includes heat radiating fins 56 to facilitate the transfer of thermal energy in conjunction with a heater/cooler 52 including a fan 58. The operation of fan 58 is controlled to regulate the temperature of tank 50*a* and thereby regulate the quantity of liquid phase fluid 46 contained therein.

Embodiment 50*b* regulates the temperature of tank 50*b* by providing a means of imparting heat to the contents of tank 50*b*. In embodiment 50*b* schematically represented in FIG. 4 a heater/cooler 52 in the form of an electrical heating element 60 is used to selectively impart heat to the contents of tank 50*b* and thereby reduce the quantity of liquid phase refrigerant 46 contained within tank 50*b*. In alternative embodiments, heating element 60 could be used in combination with a means for reducing the temperature of the flash gas tank.

Figure 5:
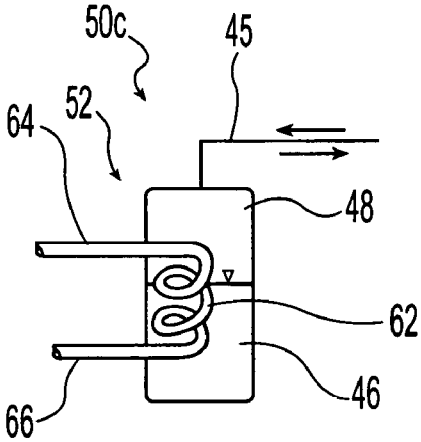
FIG. 5 is a schematic view of yet another embodiment of the flash gas tank of FIG. 1.

Embodiment 50*c* is schematically represented in FIG. 5 and includes a heater/cooler 52 in the form of a heat exchange element 62, an input line 64 and a discharge line 66. In this embodiment a fluid is circulated from input line 64 through heat exchange element 62 and then discharge line 66. Thermal energy is exchanged between the fluid circulated within heat exchange element 62 and the contents of tank 50*c* to thereby control the temperature of tank 50*c*. Heat exchange element 62 is illustrated as being positioned in the interior of tank 50*c*. In alternative embodiments, a similar heat exchange element could be positioned on the exterior of the intermediate pressure tank to exchange thermal energy therewith. The heat exchange medium that is circulated through heat exchange element 62 and lines 64, 66 may be used to either heat or cool the contents of tank 50*c*. For example, input line 64 could be in fluid communication with high temperature, high pressure line 35 and convey refrigerant therethrough that is at a temperature greater than the contents of tank 50*c* to thereby heat tank 50*c* and reduce the quantity of liquid phase refrigerant 46 contained within tank 50*c*. Discharge line 66 may discharge the high pressure refrigerant to line 37 between gas cooler 38 and expansion device 42 or other suitable location in system 30. Alternatively, input line 64 could be in fluid communication with suction line 43 whereby heating element 62 would convey refrigerant therethrough that is at a temperature that is less than that of tank 50*c* and thereby cool tank 50*c* and increase the quantity of liquid phase refrigerant 46 contained therein and thus also increase the mass of refrigerant contained therein. Discharge line 66 may discharge the low pressure refrigerant to back into line 43 between evaporator 44 and compression mechanism 32 or other suitable location in system 30. A valve (not shown) is placed in input line 64 and selectively actuated to control the flow of fluid through heat exchange element 62 and thereby control the temperature of tank 50*c* and quantity of liquid phase refrigerant 46 contained therein. Other embodiments may exchange thermal energy between the fluid conveyed within heat exchange element 62 and an alternative external temperature reservoir, i.e., either a heat sink or a heat source.

Figure 6:
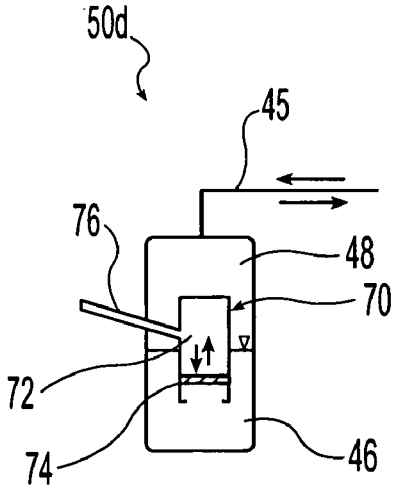
FIG. 6 is a schematic view of still another embodiment of the flash gas tank of FIG. 1.

Embodiment 50*d* is schematically represented in FIG. 6 and, instead of a heater/cooler 52, includes a variable volume element 70 that in the illustrated embodiment includes a chamber 72 and piston 74 and input 76. Piston 74 is selectively moveable to increase or decrease the volume of chamber 72 and thereby respectively decrease or increase the storage volume of tank 50*d* available for the storage of refrigerant therein. Unlike tank embodiments 50*a*–50*c* which rely upon regulation of the temperature of the intermediate pressure tank to control the quantity of liquid phase refrigerant 46 contained within the tank, tank 50*d* regulates the volume of chamber 72 to control the available storage volume for liquid phase refrigerant 46 and thereby regulate the quantity of liquid phase refrigerant 46 contained within tank 50*d*. Chamber 72 is filled with a gas, e.g., such as gaseous phase refrigerant 48, and input 76 transfers thermal energy to the gas filling chamber 72. By heating the gas filling chamber 72, the gas filling chamber 72 may be expanded, pushing piston 74 downward and reducing the available storage volume within tank 50*d*. Alternatively, cooling the gas filling chamber 72 will contract the gas, allowing piston 74 to move upward and thereby enlarging the available storage volume within tank 50*d*. Thermal transfers with the gas filling chamber 72 may take place by communicating relatively warm or cool refrigerant to chamber 72 through input 76 from another location in system 30. Input line 76 may extend into chamber 72 and have a closed end (not shown) whereby the heat exchange medium within line 76 remains within line 76 and does not enter chamber 72 such that it would contact piston 74 directly. Alternatively a heating element similar to element 60 or heat exchange element similar to element 62 could be positioned within chamber 72.

Other embodiments of flash gas tanks having a variable storage volume may utilize expandable/contractible chambers that are formed using flexible bladders. Various other embodiments of such tanks that may be used with the present invention are described in greater detail by Manole, et al. in a U.S. patent application entitled APPARATUS FOR THE STORAGE AND CONTROLLED DELIVERY OF FLUIDS, Ser. No. 10/653,502, filed on Sep. 2, 2003, and is hereby incorporated herein by reference.

Figure 7:
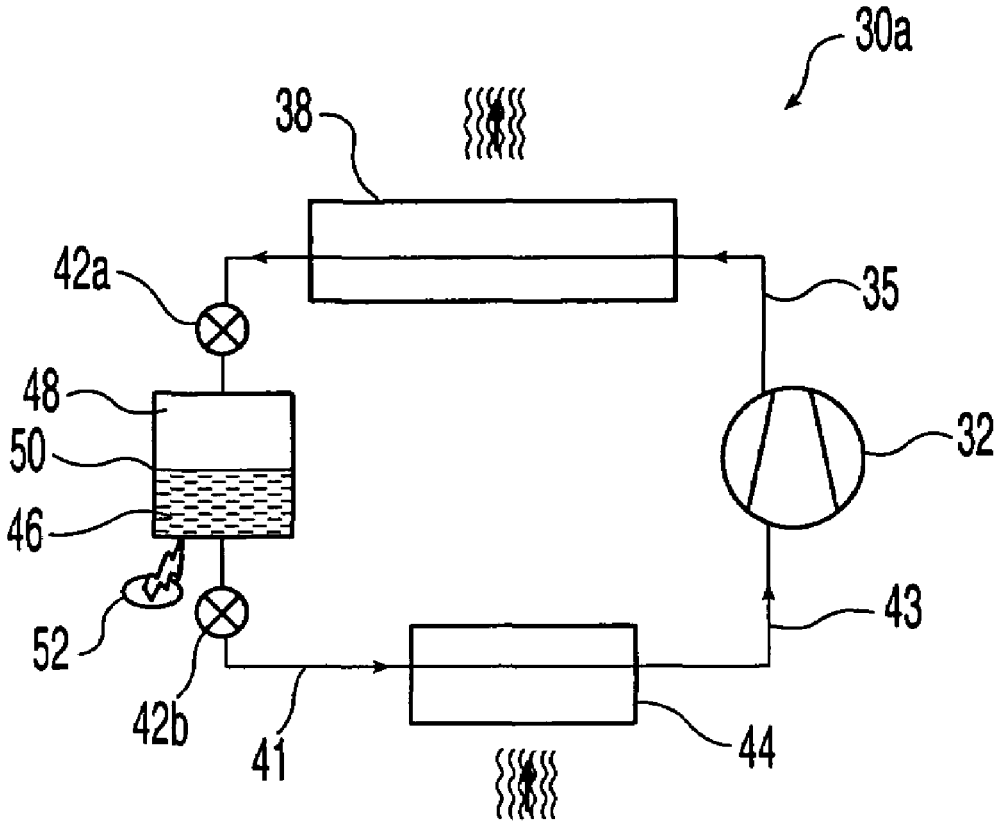
FIG. 7 is a schematic view of another vapor compression system in accordance with the present invention.

Second embodiment 30*a* of a vapor compression system in accordance with the present invention is schematically represented in FIG. 7. System 30*a* is similar to system 30 shown in FIG. 1 but includes a flash gas tank 50 in the fluid circuit disposed between a first non-variable expansion device 42*a* and a second non-variable expansion device 42*b*.

After the refrigerant is cooled in gas cooler 38, the pressure of the refrigerant is then reduced by first expansion device 42*a*. Advantageously, expansion device 42*a* reduces the pressure of the refrigerant to a subcritical pressure and the refrigerant collects in flash gas tank 50 as part liquid 46 and part vapor 48. The liquid refrigerant 46 collects at the bottom of the flash gas tank 50 and is again expanded by second expansion device 42*b*. The refrigerant then enters evaporator 44 where it is boiled and cools a secondary medium, such as air, that may be used, for example, to cool a refrigerated cabinet. The refrigerant discharged from the evaporator 44 then enters the compression mechanism 32 to repeat the cycle.

By heating or cooling the flash gas tank 50, the mass of refrigerant in the flash gas tank 50, and the gas cooler 38, can be regulated to control the pressure in the gas cooler. An ECU can monitor the pressure in the cooler 38 and control heater/cooler 52 accordingly.

If the pressure in the gas cooler 38 is above a desired pressure, the power consumption of compressor 32 is also above a desired level. The ECU can operate the heater/cooler 52 to lower the temperature of the tank 50, thereby increasing the amount of charge in the flash gas tank 50, and decreasing both the amount of charge and the pressure in the gas cooler 38. Conversely, if the pressure in the gas cooler 38 is below the desired pressure, the ECU can operate the heater/cooler 52 to increase the temperature of the tank 50, thereby increasing both the amount of charge and the pressure in the gas cooler 38. As the pressure in the gas cooler 38 changes, the heater/cooler 52 to heat or cool the flash gas tank 50 as needed so that a desirable gas cooler pressure and a desirable system capacity and efficiency can be achieved.

By selectively controlling the operation of the heater/cooler 52, the amount of charge stored in the flash gas tank 50 can be varied, which in turn varies the mass of refrigerant, and pressure, in gas cooler 38, to achieve the gas cooler pressure corresponding to the desired capacity and/or efficiency. As discussed above, by regulating the pressure in the gas cooler 38, the specific enthalpy of the refrigerant at the entry of the evaporator 44 (point C in FIG. 2) can be modified, and the capacity and/or efficiency of the system 30*a* controlled. Other details of the system 30*a* are similar to that of system 30, and thus are not discussed herein.

Figure 8:
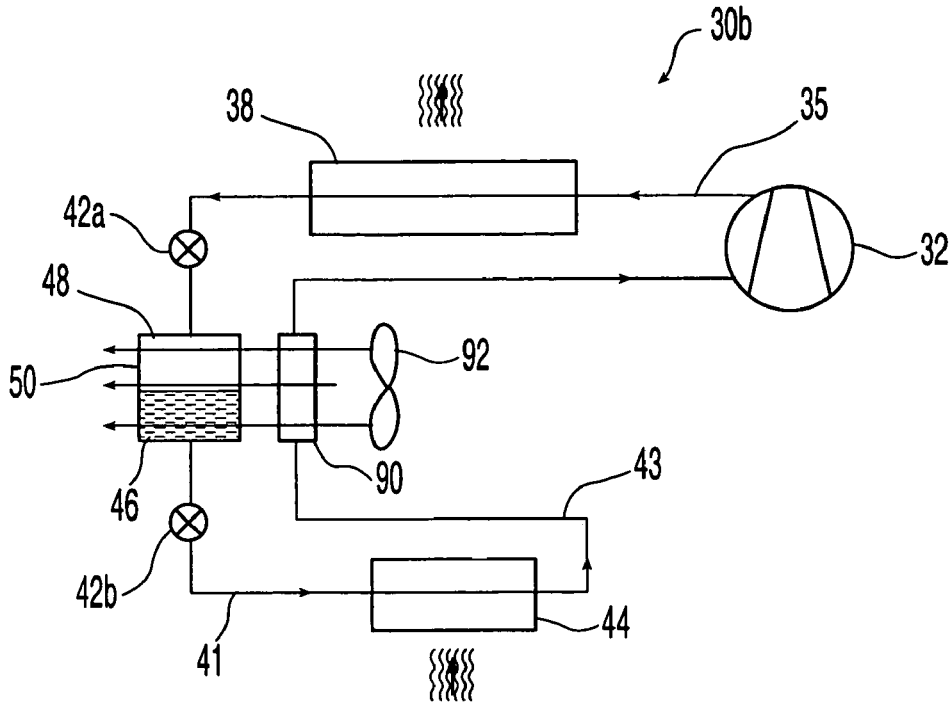
FIG. 8 is a schematic view of yet another vapor compression system in accordance with the present invention.

Third embodiment 30*b* of a vapor compression system in accordance with the present invention is schematically represented in FIG. 8. System 30*b* is similar to system 30*a* shown in FIG. 8 but includes a heating/cooling mechanism other than the heater/cooler 52 of system 30*a*. More particularly, the system 30*b* can include a heat exchanger in the form of a serpentine radiator 90 indicated schematically in FIG. 8 and disposed in the fluid circuit between the evaporator 44 and the compressor mechanism 32. System 30*b* also includes an auxiliary cooling device in the form of an air moving device or fan 92 disposed proximate or adjacent the flash gas tank 50. The fan 92 can be used to blow air over the relatively cool heat exchanger 90 and toward the tank 50 such that the air flow across heat exchanger 90 generated by fan 92 cools the flash gas tank 50 and the refrigerant therein. An ECU can be used to activate/deactivate fan 92 and/or control the speed of fan 92 and thereby regulate the temperature of refrigerant within tank 50.

The fan 92 and the heat exchanger 90 form a temperature adjustment device capable of adjusting the temperature of the refrigerant in the flash gas tank 50. Thus, the fan 92 and the heat exchanger 90 can regulate the pressure of the refrigerant in the gas cooler 38 and the capacity and efficiency of the system 30*b*. Other details of the system 30*b* are similar to that of systems 30, 30*a* and thus are not discussed herein.

Fan 92 may also be used without heat exchanger 90 wherein fan 92, blows air directly on flash gas tank 50 in order to change the temperature of the refrigerant therein.

Figure 9:
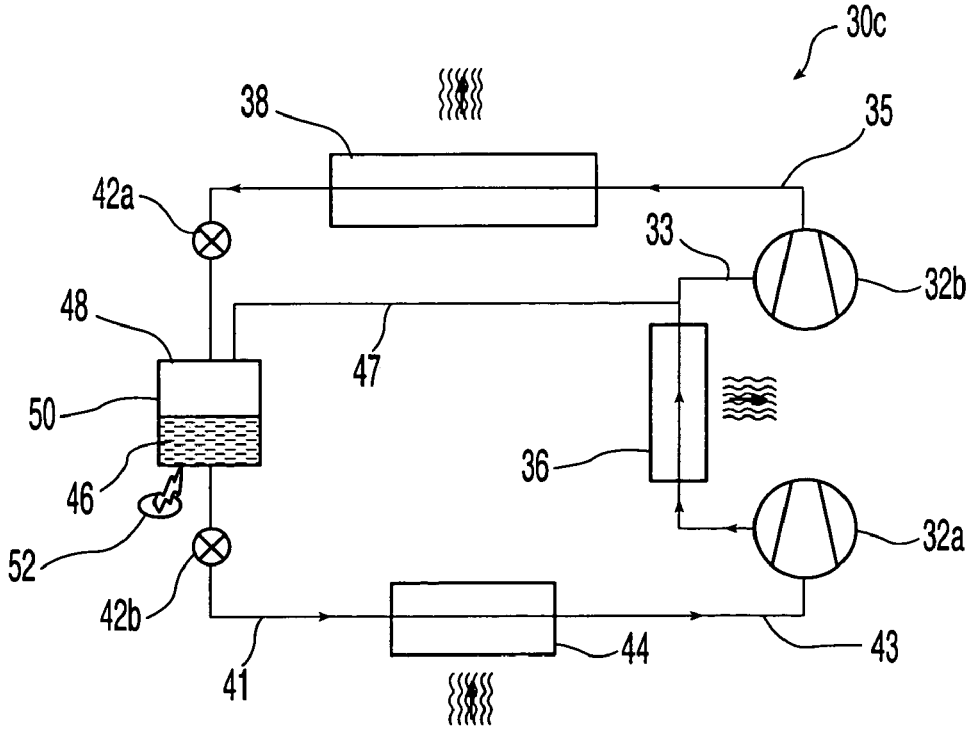
FIG. 9 is a schematic view of still another vapor compression system in accordance with the present invention.

Fourth embodiment 30*c* of a vapor compression system in accordance with the present invention is schematically represented in FIG. 9. System 30*c* is similar to systems 30*a*, 30*b* shown in FIGS. 7, 8, but includes an intercooler 36 disposed between a first compression mechanism 32*a* and a second compression mechanism 32*b*. One or both of a heater/cooler 52 and a fan 92 can be included for controlling the temperature of the flash gas tank 50.

In this embodiment, the first compressor 32*a* compresses the refrigerant from a low pressure to an intermediate pressure. The cooler 36 is positioned between the compressors 32*a*, 32*b* to cool the intermediate refrigerant. After the fluid line 33 communicates the refrigerant to the second compressor 32*b*, the second compressor 32*b* compresses the refrigerant from the intermediate pressure to the supercritical pressure.

In the embodiment of FIG. 9, the illustrated flash gas tank 50 is shown having a fluid line 47 providing fluid communication between the tank 50 and the system at a location between first and second compression mechanisms 32*a*, 32*b*, i.e., fluid line 33. In this embodiment, fluid line 47 allows vapor phase refrigerant from tank 50 to be communicated to line 33. In the illustrated embodiment, fluid line 47 provides an unregulated fluid passage between tank 50 and fluid line 33 leading to second compression mechanism 32*b*, i.e., there is no valve present in fluid line 47 that is used to regulate the flow of fluid therethrough during operation of the vapor compression system. However, line 47 may alternatively include a valve to regulate the flow of refrigerant therethrough. Other details of the system 30*c* are similar to that of systems 30, 30*a*, 30*b*, are thus are not discussed in detail herein.

The systems discussed above are described as including a fan 92 or other form of a heater/cooler 52 in order to change the temperature of the refrigerant within the flash gas tank 50. The present invention is not limited to these exemplary embodiments of a heating or cooling device, however. Rather, the present invention may include alternative devices capable of heating or cooling the refrigerant, such as a Peltier device, for example. Peltier devices are well known in the art and, with the application of a DC current, move heat from one side of the device to the other side of the device and, thus, could be used for either heating or cooling purposes.

In the embodiments in which the temperature of the flash gas tank is regulated to vary the mass of refrigerant contained therein, the temperature of the refrigerant contained within the flash gas tank may also be regulated by using a heating/cooling device to adjust the temperature of the refrigerant in the fluid circuit immediately upstream of the flash gas tank and thereby indirectly control the temperature of the refrigerant within the tank by controlling the temperature of the refrigerant entering the tank. For example, a Peltier device, or other heating/cooling device, could be mounted on the fluid line entering tank 50 in proximity to tank 50, e.g., between expansion device 42*a* and tank 50 in the embodiments of FIGS. 7, 8 and 9.

It is also possible to add a filter or filter-drier immediately upstream of any of the expansion devices included in the above embodiments. Such a filter can prevent any sort of contamination in the system, e.g., copper filings, abrasive materials or brazing debris, from collecting in the expansion device and thereby obstructing the passage of refrigerant.

While this invention has been described as having an exemplary design, the present invention may be further modified within the spirit and scope of this disclosure. This application is therefore intended to cover any variations, uses, or adaptations of the invention using its general principles. Particularly, the components of the various embodiments described herein may be combined in numerous ways within the scope of the present invention.

What is claimed is:

1. A transcritical vapor compression system comprising:

a fluid circuit circulating a refrigerant in a closed loop, said fluid circuit having operably disposed therein, in serial order, a compressor, a first heat exchanger, at least one non-variable expansion device and a second heat exchanger wherein said compressor compresses the refrigerant from a low pressure to a supercritical pressure, said first heat exchanger is positioned in a high pressure side of said fluid circuit and contains refrigerant at a first supercritical pressure and said second heat exchanger is positioned in a low pressure side of said fluid circuit and contains refrigerant at a second subcritical pressure, said at least one non-variable expansion device reducing the pressure of the refrigerant from a supercritical pressure to a relatively lower subcritical pressure wherein said at least one non-variable expansion device defines a pressure reduction substantially equivalent to the pressure difference between said first pressure and said second pressure;

a refrigerant storage vessel in fluid communication with said fluid circuit via an open fluid conduit which provides both outflow and inflow of refrigerant to and from said refrigerant vessel and said fluid circuit, said refrigerant storage vessel having a variable mass of refrigerant stored therein; and a thermal control device disposed in thermal exchange relationship with said refrigerant storage vessel, wherein the mass of refrigerant within said refrigerant storage vessel is adjustable with said thermal control device to in turn adjust the mass of refrigerant in said fluid circuit.

2. The system of claim 1 wherein said refrigerant storage vessel is in communication with said fluid circuit between said first heat exchanger and said at least one non-variable expansion device.

3. The system of claim 1 wherein said at least one non-variable expansion device comprises two non-variable expansion devices disposed in said fluid circuit between said first and second heat exchangers, said refrigerant storage vessel being disposed in fluid communication with the fluid circuit between said non-variable expansion devices.

4. The system of claim 1 wherein said non-variable expansion device comprises at least one capillary tube.

5. The system of claim 1 wherein said non-variable expansion device comprises at least one fixed orifice expansion device.

6. The system of claim 1 wherein said thermal control device comprises a third heat exchanger disposed between said second heat exchanger and said compressor.

7. The system of claim 6 wherein said thermal control device further comprises an air moving device configured to move air across said third heat exchanger and toward said refrigerant storage vessel.

8. The system of claim 1 wherein said compressor is a two stage compressor having a first compressor mechanism compressing the refrigerant from the low pressure to an intermediate pressure and a second compressor mechanism compressing the refrigerant from the intermediate pressure to a supercritical pressure, said fluid circuit further including a fluid line providing communication from said refrigerant storage vessel to a location in said fluid circuit between said first and second compressor mechanisms.

9. The system of claim 8 wherein said at least one non-variable expansion device comprises two non-variable expansion devices, said refrigerant storage vessel being disposed in fluid communication with the fluid circuit between said non-variable expansion devices.

10. The system of claim 1 wherein said thermal control device comprises a heating element.

11. The system of claim 1 wherein said thermal control device comprises a conduit containing a fluid, the fluid in thermal exchange relationship with the refrigerant.

12. The system of claim 1 wherein said refrigerant storage vessel is in fluid communication with said fluid circuit via a single conduit.

13. A transcritical vapor compression system comprising:

a fluid circuit circulating a refrigerant in a closed loop, said fluid circuit having operably disposed therein, in serial order, a compressor, a first heat exchanger, at least one non-variable expansion device and a second heat exchanger wherein said compressor compresses the refrigerant from a low pressure to a supercritical pressure, said first heat exchanger is positioned in a high pressure side of said fluid circuit and contains refrigerant at a first supercritical pressure and said second heat exchanger is positioned in a low pressure side of said fluid circuit and contains refrigerant at a second subcritical pressure, said at least one non-variable expansion device reducing the pressure of the refrigerant from a supercritical pressure to a relatively lower pressure wherein said at least one non-variable expansion device defines a pressure reduction substantially equivalent to the pressure difference between said first pressure and said second pressure;

a refrigerant storage vessel in fluid communication with said fluid circuit between said first and second heat exchangers; and a temperature adjustment device disposed in thermal exchange with said refrigerant storage vessel, said temperature adjustment device operable to transfer heat to refrigerant in said storage vessel and to remove heat from refrigerant in said storage vessel wherein a temperature of refrigerant in said refrigerant storage vessel is adjustable with said temperature adjustment device.

14. The system of claim 13 wherein said temperature adjustment device comprises an air moving device configured to move air across said refrigerant storage vessel.

15. The system of claim 14 wherein said temperature adjustment device further comprises a third heat exchanger disposed between said second heat exchanger and said compressor, said air moving device moving air across said third heat exchanger toward said refrigerant storage vessel.

16. The system of claim 13 wherein selective operation of said temperature adjustment device controls the mass of the refrigerant in said refrigerant storage vessel.

17. The system of claim 13 wherein said refrigerant storage vessel is in communication with said fluid circuit between said first heat exchanger and said at least one non-variable expansion device.

18. The system of claim 13 wherein said at least one non-variable expansion device comprises two non-variable expansion devices disposed in said fluid circuit between said first and second heat exchangers, said refrigerant storage vessel being disposed in communication with the fluid circuit between said non-variable expansion devices.

19. The system of claim 13 wherein said compressor is a two stage compressor having a first compressor mechanism compressing the refrigerant from the low pressure to an intermediate pressure and a second compressor mechanism compressing the refrigerant from the intermediate pressure to a supercritical pressure, said fluid circuit further including a fluid line providing communication from said refrigerant storage vessel to a location in said fluid circuit between said first and second compressor mechanisms.

20. The system of claim 19 wherein said at least one non-variable expansion device comprises two non-variable expansion devices, said refrigerant storage vessel being disposed in communication with the fluid circuit between said non-variable expansion devices.

21. The system of claim 13 wherein said temperature adjustment device comprises a heating element.

22. The system of claim 13 wherein said temperature adjustment device comprises a conduit containing a fluid, the fluid in thermal exchange relationship with the refrigerant.

23. The system of claim 13 wherein said refrigerant storage vessel is in fluid communication with said fluid circuit via a single conduit.

24. A method of controlling a transcritical vapor compression system, said method comprising:

providing a fluid circuit circulating a refrigerant in a closed loop, the fluid circuit having operably disposed therein, in serial order, a compressor, a first heat exchanger, at least one non-variable expansion device and a second heat exchanger;

compressing the refrigerant from a low pressure to a supercritical pressure in the compressor;

removing thermal energy from the refrigerant in the first heat exchanger;

reducing the pressure of the refrigerant in the at least one non-variable expansion device wherein said at least one non-variable expansion device defines a pressure reduction substantially equivalent to a pressure difference between a first supercritical pressure of the refrigerant within the first heat exchanger and a second subcritical pressure of the refrigerant within the second heat exchanger;

adding thermal energy to the refrigerant in the second heat exchanger;

providing a refrigerant storage vessel in fluid communication with said fluid circuit via an open fluid conduit which provides both outflow and inflow of refrigerant to and from the refrigerant storage vessel and the fluid circuit;

providing a thermal control device in thermal exchange relationship with the refrigerant storage vessel; and controlling the mass of refrigerant in the refrigerant storage vessel with the thermal control device to thereby control the mass of refrigerant in the fluid circuit and thereby regulate the capacity of the system.

25. The method of claim 24 wherein the step of controlling the mass of refrigerant in the refrigerant storage vessel comprises controlling the temperature of the refrigerant in the refrigerant storage vessel.

26. The method of claim 24 wherein reducing the pressure of the refrigerant in the at least one non-variable expansion device comprises reducing the pressure of the refrigerant in two non-variable expansion devices.

27. The method of claim 24 wherein the compressor comprises a first compressor mechanism compressing the refrigerant from the low pressure to an intermediate pressure, a second compressor mechanism compressing the refrigerant from the intermediate pressure to the supercritical pressure, and a first fluid line communicating refrigerant from the first compressor mechanism to the second compressor mechanism, the method further comprising providing the fluid circuit with a second fluid line communicating refrigerant from the refrigerant storage vessel to the first fluid line.

28. The method of claim 27 wherein reducing the pressure of the refrigerant in the at least one non-variable expansion device comprises reducing the pressure of the refrigerant in two non-variable expansion devices and the refrigerant storage vessel is disposed in communication with the fluid circuit between the two non-variable expansion devices.

29. A compression system comprising:

a fluid circuit circulating a refrigerant in a closed loop, said fluid circuit having operably disposed therein, in serial order, a compressor, a first heat exchanger, at least one expansion device and a second heat exchanger wherein said compressor compresses the refrigerant from a low pressure to a high pressure, said first heat exchanger is positioned in a high pressure side of said fluid circuit and contains refrigerant at the high pressure and said second heat exchanger is positioned in a low pressure side of said fluid circuit and contains refrigerant at the low pressure, said at least one expansion device reducing the pressure of the refrigerant from the high pressure to the low pressure and defining a pressure reduction substantially equivalent to the pressure difference between the low pressure and the high pressure;

a refrigerant storage vessel in fluid communication with said fluid circuit, said refrigerant storage vessel having a variable mass of refrigerant therein; and a thermal control device disposed in thermal exchange relationship with said refrigerant storage vessel, said temperature adjustment device operable to transfer heat to refrigerant in said storage vessel and to remove heat from refrigerant in said storage vessel wherein the mass of refrigerant within said refrigerant storage vessel is adjustable with said thermal control device to in turn adjust the mass of refrigerant in said fluid circuit.

30. The system of claim 29 wherein said thermal control device comprises a heating element.

31. The system of claim 29 wherein said thermal control device comprises an air moving device configured to move air across said refrigerant storage vessel.

32. The system of claim 29 wherein said thermal control device comprises a conduit containing a fluid, the fluid in thermal exchange relationship with the refrigerant.

33. The system of claim 29 wherein said refrigerant storage vessel is in fluid communication with said fluid circuit via a single conduit.

34. A transcritical vapor compression system comprising:

a fluid circuit circulating a refrigerant in a closed loop, said fluid circuit having operably disposed therein, in serial order, a compressor, a first heat exchanger, at least one non-variable expansion device and a second heat exchanger wherein said compressor compresses the refrigerant from a low pressure to a supercritical pressure, said first heat exchanger is positioned in a high pressure side of said fluid circuit and contains refrigerant at a first supercritical pressure and said second heat exchanger is positioned in a low pressure side of said fluid circuit and contains refrigerant at a second subcritical pressure, said at least one non-variable expansion device reducing the pressure of the refrigerant from a supercritical pressure to a relatively lower subcritical pressure wherein said at least one non-variable expansion device defines a pressure reduction substantially equivalent to the pressure difference between said first pressure and said second pressure;

a refrigerant storage vessel in fluid communication with said fluid circuit, said refrigerant storage vessel having a variable mass of refrigerant stored therein; and a thermal control device disposed in thermal exchange relationship with said refrigerant storage vessel, wherein the mass of refrigerant within said refrigerant storage vessel is adjustable with said thermal control device to in turn adjust the mass of refrigerant in said fluid circuit, wherein said thermal control device comprises an air moving device configured to move air across said refrigerant storage vessel.

* * * * *